United States Patent [19]

Motev

[11] Patent Number: 4,712,474

[45] Date of Patent: Dec. 15, 1987

[54] AUTOMATIC ARTICLE HANDLING AND SCREEN PRINTING APPARATUS

[75] Inventor: Phil Motev, Lincolnwood, Ill.

[73] Assignee: American Screen Printing Equipment Company, Chicago, Ill.

[21] Appl. No.: 794,508

[22] Filed: Nov. 4, 1985

[51] Int. Cl.[4] ..... B41F 17/22

[52] U.S. Cl. ..... 101/38 A; 101/129; 198/468.4

[58] Field of Search ..... 101/38 R, 38 A, 39, 101/40, 126, 35, 129; 198/468.4, 468.6; 414/917

[56] References Cited

U.S. PATENT DOCUMENTS

| | | | |
|---|---|---|---|
| 3,533,353 | 10/1970 | Dubuit | 101/40 |
| 4,176,598 | 12/1979 | Dubuit | 101/38 A |
| 4,282,806 | 8/1981 | Lala | 101/38 R |
| 4,398,627 | 8/1983 | Saccani | 101/38 A |
| 4,411,191 | 10/1983 | Combeau | 101/38 A |

FOREIGN PATENT DOCUMENTS

| | | | |
|---|---|---|---|
| 1177942 | 1/1970 | United Kingdom | 198/468.4 |

*Primary Examiner*—Clifford D. Crowder

*Attorney, Agent, or Firm*—Fitch, Even, Tabin & Flannery

[57] ABSTRACT

A method and apparatus for automatically screen printing on objects includes a first transfer mechanism having suction cups for swinging the objects from a supply station at which is a preregistering device which rotates the objects into a predetermined orientation closely positioned to reference position to which the object is printed. From the preregistering station, the objects are swung by a second oscillating transfer means to a third oscillatory transfer means which swings the preregistered objects to the printing station. At the printing station, the objects are rotated relative to a printing screen by a rotating chuck device. After printing, grippers are swung into the printing station to remove the printed object and to convey the printed object to discharge station at which is located a discharge conveyor of UV curing apparatus.

20 Claims, 11 Drawing Figures

10
12
13
13
14
15
16
17
18
20
20
20
20
20
20
20
23
23
25
26
30
32
32
36
37
38
40
40a
44
60
62
64
65
108
110
150
181
183
185
235
236
281
290

20d
20
141
138
144
142
140
57a
136
115
118
152
119
151
120
150
164
60
155
156
280
127
167
124
122
121
166
281
129
167
168
135
130
169
131
170
138
172
134
171
132
174
177
173
175
176

91
90
90a
92
93
71
72
70
74
86
86
20
20b
106
96
103
100
102
101
104
99
96
97
100

44
20b
9
9
275
277
200
240
241
242
243
253a
253
250
260
270
271
260
245
259
243
252
246
248
12
240
20b
275
276
278
279
280

AUTOMATIC ARTICLE HANDLING AND SCREEN PRINTING APPARATUS

This invention relates to a method and apparatus for automatically handling and screen printing on objects.

BACKGROUND OF THE INVENTION

The present invention is directed to providing a new and improved automated screen printing which overcomes many of the shortcomings of conventional screen printing apparatus in which the object, such as a container, is rotated while ink is applied through a screen fabric to the object. In semiautomatic screen printing apparatus, such as shown in U.S. Pat. No. 4,282,806, the article to be printed may be loaded manually in a hopper and a container is transfered by a single transfer arm directly from the hopper to the printing station. The printing head carrying the screen is raised to accommodate feeding of the object into a chuck which automatically rotates the object to a reference position for initiation of printing. A rack and pinion drive rotate the chuck and the object in timed relationed to movement of the screen relative to a stationary screen and flood bar. After printing, the object is removed manually and sent to a UV curing operation. One problem with such semi-automatic equipment is that it is relatively slow in production. A considerable portion of the cycle is spent in raising and in lowering the printing head and in turning the container to its reference position.

Silk screen printing apparatus disclosed in the aforementioned patent may be set up rather quickly to handle various diameters of containers. When changing sizes of containers, the rotational velocity of container surface is matched to the linear velocity of the screen by changing the size of the gear driven by the rack. Also, the nest or container receiving pocket on the transfer arm is changed where the difference in container diameter is quite large. Such set up time is relatively simple and easily accomplished as contrasted to existing conventional fully automated equipment used for silk screening apparatus.

More specifically, a known silk screen printing apparatus of the automated kind employs a walking beam transfer mechanism which has a number of container receiving grooves or notches therein to hold a series of containers each being moved incrementally toward the printing station. Such a system is difficult to set up for different sizes of containers or for different objects. The change of size of the walking beam and the adjustments of the movement thereof, as well as to change the rotational speeds, has resulted in many hours of set up time being required for substantial changes in container diameters. Furthermore, the articles are jostled as they are moved step by step by the walking beam and the articles may be marked or marred by such movement. There is a loss of accuracy of container position with such a walking beam. Often this walking beam printing equipment is not able to be quickly converted from cylindrical containers to other container shapes such as oval or conical.

Thus, there is a need in the industry for an automatic screen printing apparatus that may be readily set up to handle each of several sizes as well as shapes of containers. For instance, some users may change from a one ounce container to a quart container, and from a cylindrical to an oval container, and they desire that the set up time for the changeover be similar to that used for semi-automatic screen printing apparatus of U.S. Pat. No. 4,282,806.

In addition to having shortcomings in handling various sizes and shapes of containers, existing automatic screen printing apparatus is complicated and expensive. The walking beams and chain conveyors used heretofore for article feeding and handling involved considerable mass and momentum to be overcome in each printing and feeding cycle. When using a large number of moving parts, the adjustments thereof, the tolerance buildups and the multiple adjustments necessary to obtain the desired position of registration of the printed material on the container are time consuming. Furthermore, large chain conveyors or walking beam conveyors add considerable to the expense of the automatic screen printing apparatus relative to semi-automatic screen printing apparatus.

Accordingly, a general object of the invention is to provide a new and improved automatic screen printing apparatus.

Another object of the invention is to provide an automatic screen printing apparatus with improved article handling and positioning means to handle articles at high speeds and with simple and inexpensive equipment.

These and other objects and advantages of the invention will become apparent from the following description of the invention taken in connection with the accompanying drawings.

DETAILED DESCRIPTION OF THE DRAWINGS

FIG. **4*a*** illustrates the drive for the transfer means to remove the container from the print station.

Figure 5:
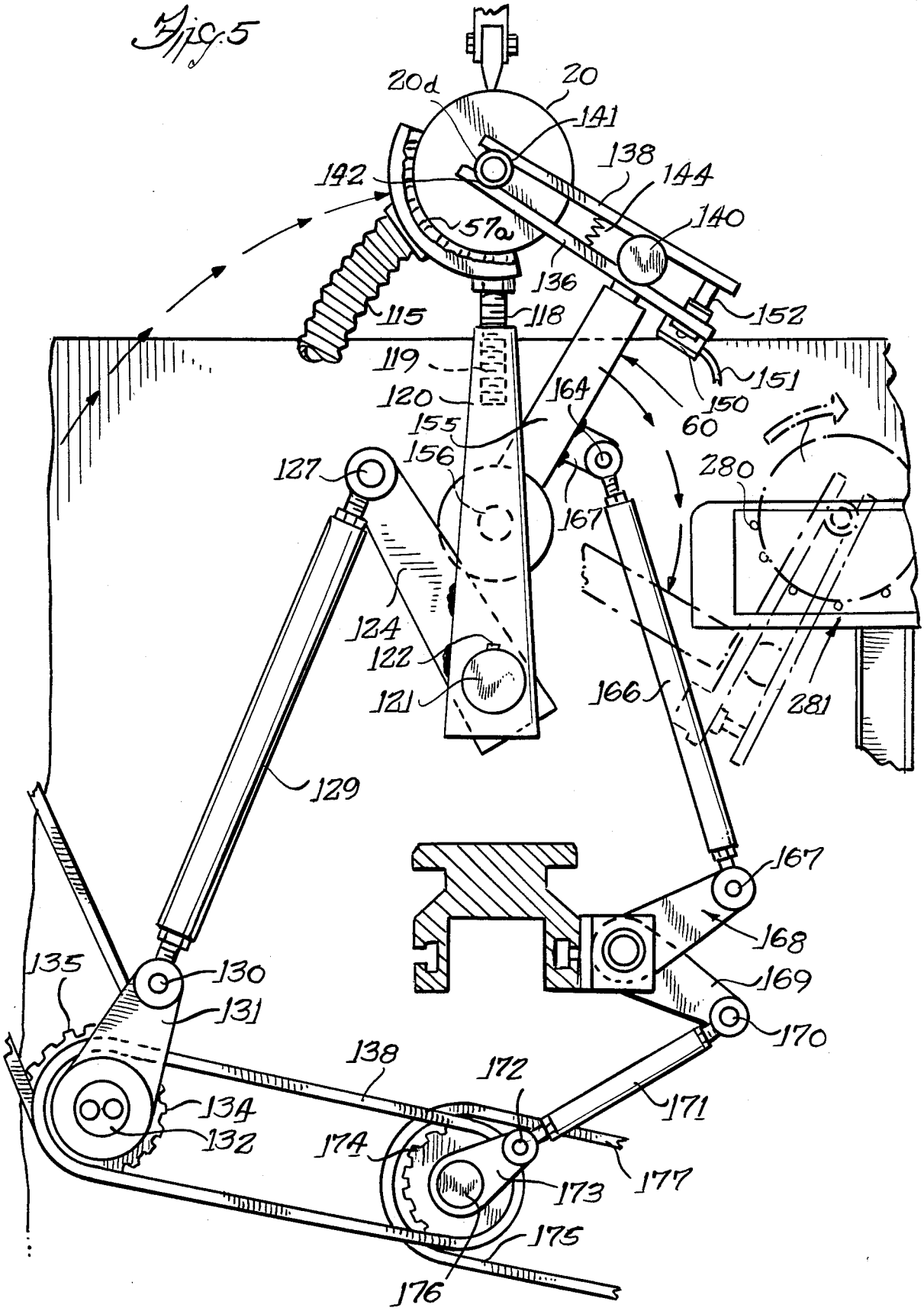

FIG. 5 illustrates the drive for the print transfer arm and for the discharge transfer arm.

Figure 6:
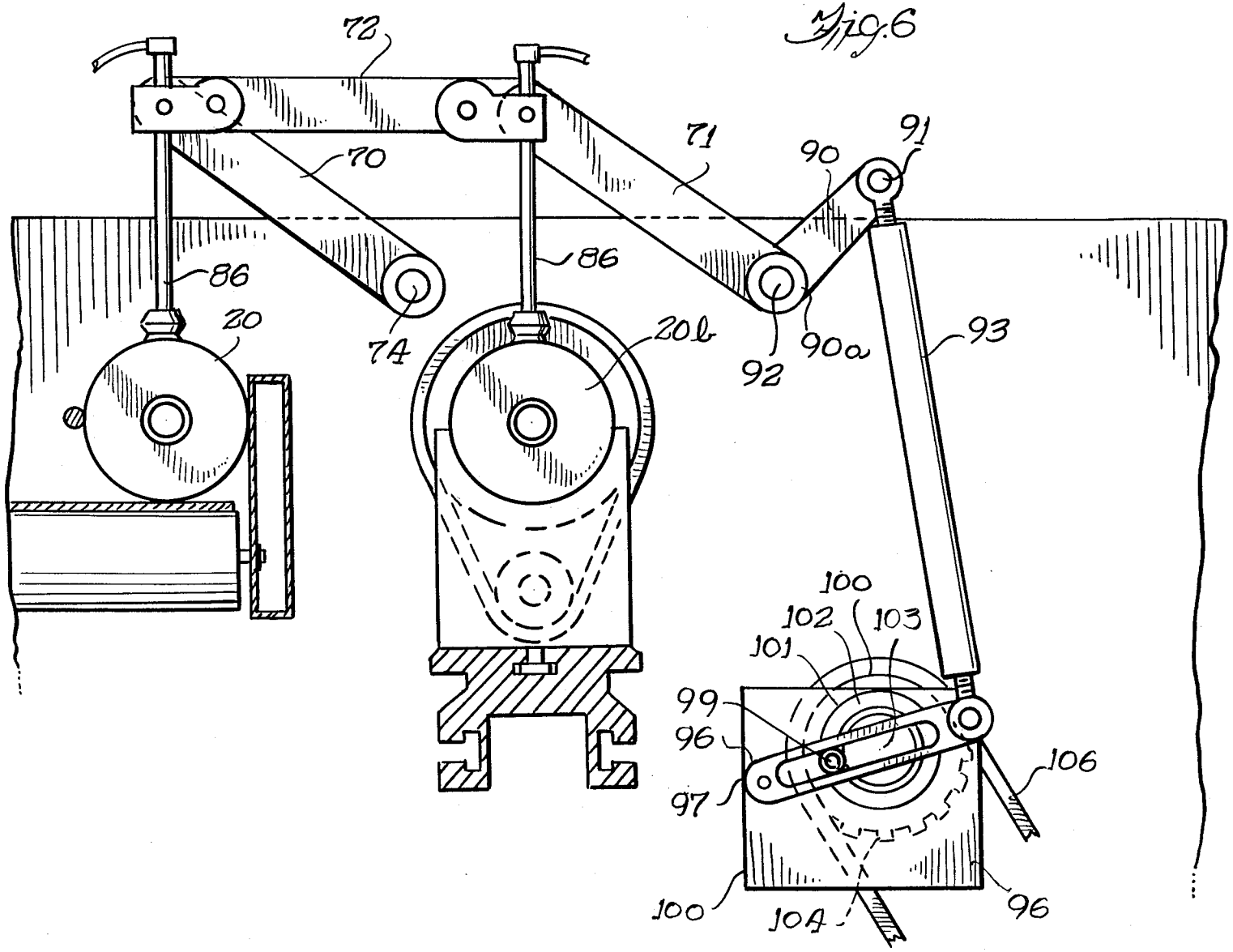

FIG. 6 is a view showing the first transfer arms when picking up containers for transferring from the supply station and the preregistration station.

Figure 7:
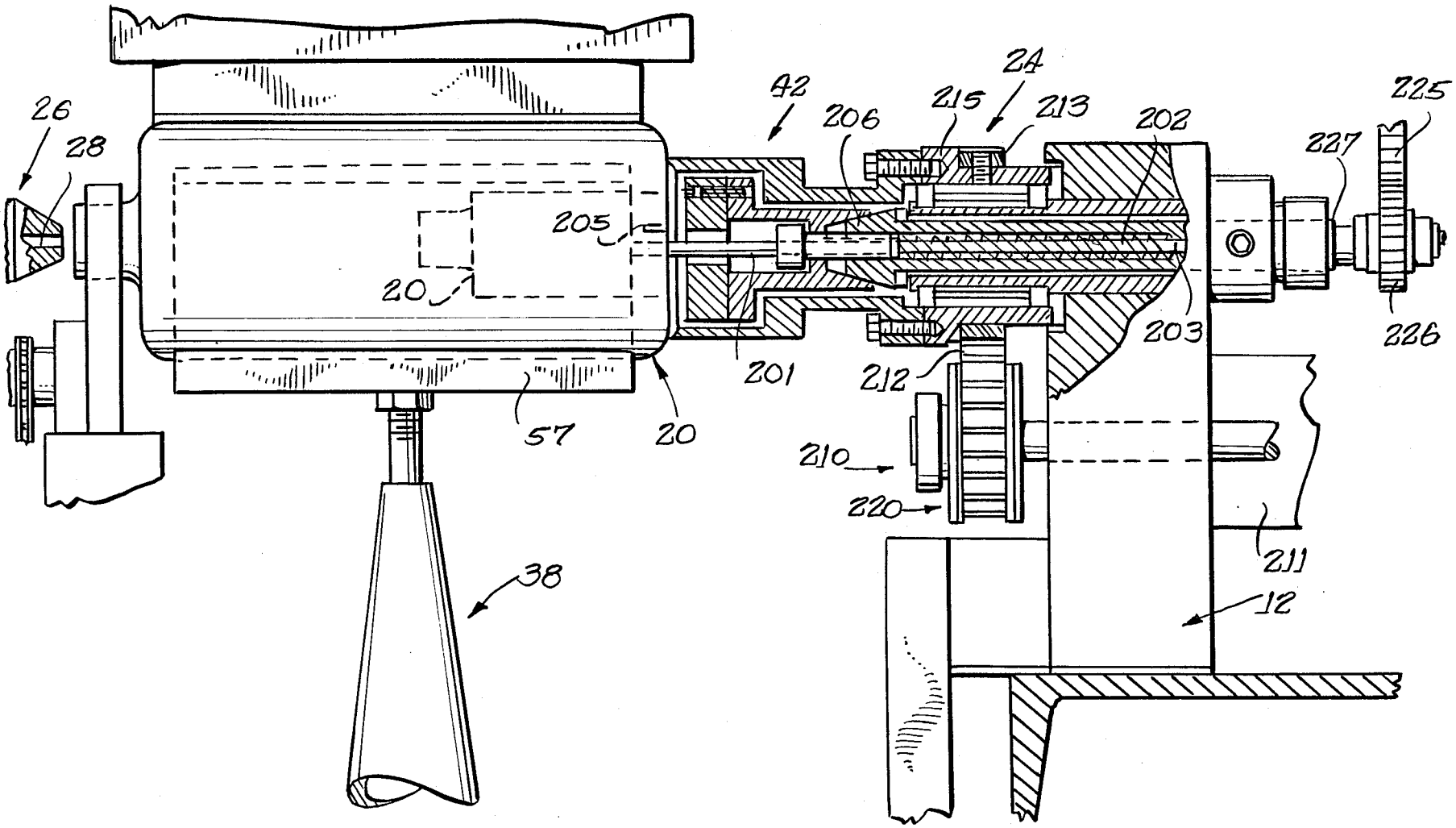

FIG. 7 is a partially sectioned view of the printing station and a chuck thereat and constructed in accordance with the preferred embodiment of the invention.

Figures 8, 9, 10:
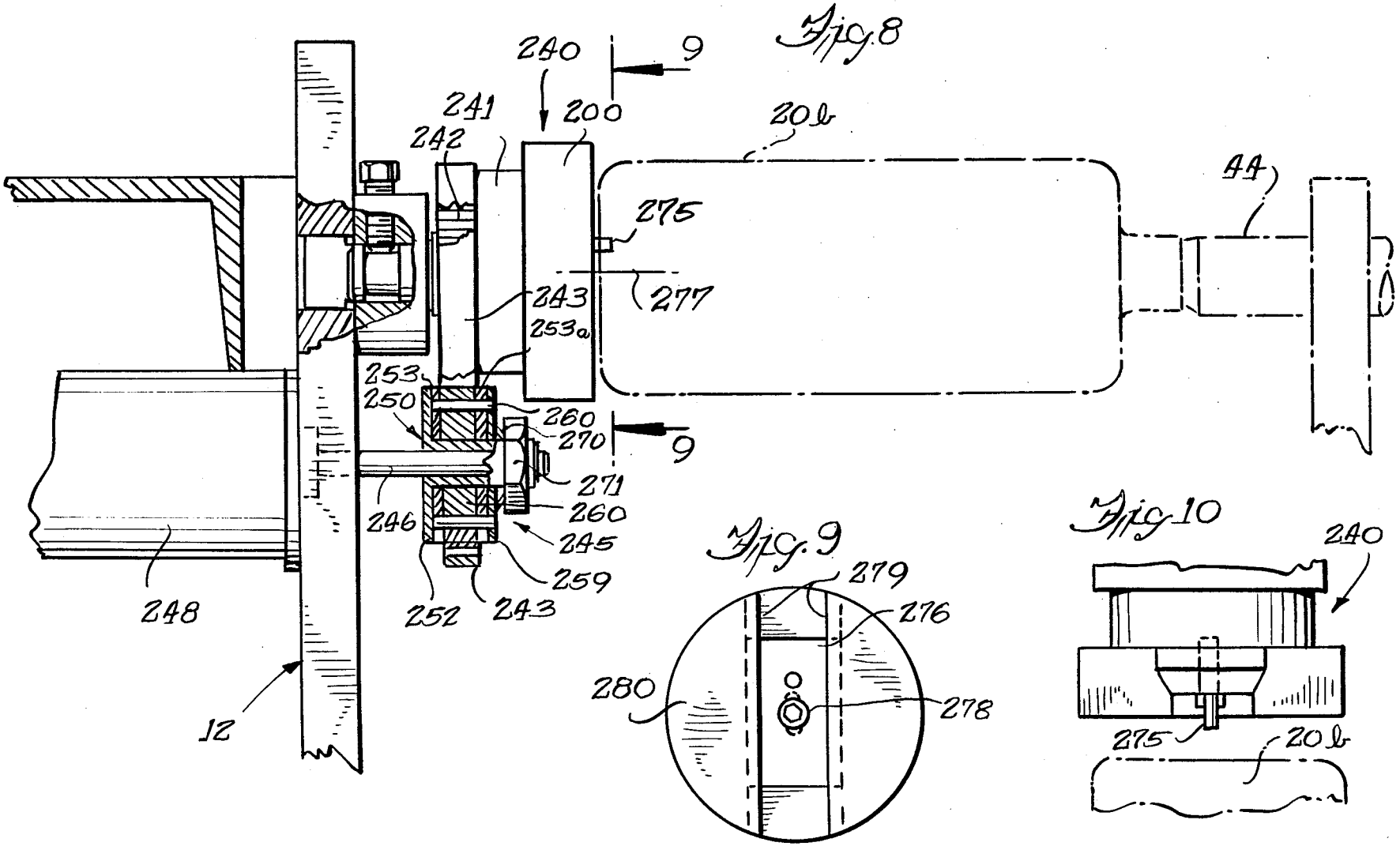

FIG. 8 is a partially sectioned view of the chuck and slip clutch at the preregistration station.

FIG. 9 is an enlarged view of a preregistering pin and its mounting at the preregistration station.

FIG. 10 is a view of the preregistering pin for engagement with the ramp on the container at the preregistration station.

DETAILED DESCRIPTION OF THE PREFERRED EMBODIMENTS

As shown on the drawings for purposes of ullustration, the invention is embodied in a screen printing apparatus 10 which includes a frame 10, including a pair of upstanding side frame members 13 between which extends a front frame, plate 12. The frame supports a screen assembly 14 above which is mounted a squeegee assembly 16 comprising a squeegee 17 and a flood bar 18. Objects to be printed, which are usually in the form of a cylindrical or oval container 20, although other objects may be imprinted, are mounted for rotation beneath a screen is for movement relative to the screen and squeegee assembly. Herein, the container 20 is rotated by a rotatable chuck 42 at the inner side of the machine and the opposite small diameter end of the container is mounted for rotation by a rotatable spindle 26 which usually has an air conduit 28 (FIG. 7) therein through which air is blown into the interior of the container to assist in holding the container wall rigid during the printing of the operation.

U.S. Pat. No. 4,282,806 which is hereby incorporated by reference as if fully reproduced herein disclosed an apparatus, as above described, but is termed a "semiautomatic" apparatus in that it does not have an automatic feed apparatus which can automatically transfer containers to the printing station 23 and beneath the printing screen and then remove the containers automatically from the printing station for conveying away to a curing apparatus for the UV sensitive ink which is cured by exposure to UV light.

While there have been automated devices for printing on silk screen objects these are usually quite elaborate and expensive mechanisms which are not readily convertible to handle different sizes and shapes of containers. Many users of screen printing apparatus have different sizes and shapes of containers which they desire to be imprinted; but the time and expense of conversion of the automatic equipment between container sizes or shapes is almost cost prohibitive. Further, the conventional handling apparatus uses transfer chain conveyors or walking beams which are large and of such weight and mass as to make the automatic equipment relatively slow in the number of containers which are processed per hour. For instance it is desired to handle containers in the range of 3000 to 6000 per hour which is one container per second or less. On the other hand, the semiautomatic equipment shown in U.S. Pat. No. 4,282,806 can be readily adjusted to handle different sizes of shapes of containers with one of the principal changes being to change the gear 318 shown in that patent to a different diameter gear so as to correlate the rotational speed of the chuck with the linear travel speed of the printing screen. This equipment of U.S. Pat. No. 4,282,806 lacks the capability however, of high speed production. Thus, there is a need for a new and improved automatic screen printing apparatus which can be readily changed to accommodate different sizes of containers or shapes of containers and which has relatively few and simple parts oparating at a relatively high speed, for example, 3000 to 6000 containers per hour. Also, important to any successful automatic machine is desire that the machine be relatively trouble-free in operation.

In accordance with the present invention, the speed of operation of the automatic screen printing apparatus is increased by moving containers 20 through a plurality of short arcuate swinging motions and by transfering a container from and between arcuate transfer mechanisms 37 and 38 to the printing station 23 preferably while the containers 20 are held in predetermined positions. To this end, it is preferred that the containers are oriented to a predetermined orientation, i.e., a preregistering of the containers, 20 at a preregistering station 30 wherein each container is located at substantially the rotational position it is at when the printing is commenced. This initial position at the start of printing may be called a "reference position". Because the container need be turned only slightly from the preregistered position to the reference positon prior to initiation of the printing operation the time needed for orientation at the printing station 23 can be reduced. The speed of operation has further been increased in the present invention from the semiautomatic operation disclosed in U.S. Pat. No. 4,242,806 in that the print head carrying the screen assembly 14 and squeegee assembly 16 need not be lifted by the parallelogram linkages 32 on which are mounted squeegee assembly 16 and the screen printing assembly 14 as disclosed in U.S. Pat. No. 4,242,846. It has been found that almost one-half of the time used for the printing cycle in the patented apparatus is used to raise and lower the printing head assembly. Herein, the printing head assembly may be raised and lowered by the parallelogram linkage 32 in order to do other auxiliary operations and, for this reason only, the parallel lifting mechanism has been retained although it may be dispensed with if no auxiliary operation is desired. The printing head is clearly shown in FIG. 2 and reference may be had to U.S. Pat. No. 4,282,806 for a description of the parts of the printing head shown in FIG. 2.

Also in accordance with the invention, the arcuate transfer means for transferring the containers from supply station 25 to the preregistering station 30 and from the preregistering station to the printing station 23 includes a first oscillatory transfer arm means 37 and a second oscillatory transfer arm means 38 which lifts and transfers containers simultaneously between the supply station 25 and the preregistering station 30 and between the printing station 23 and a discharge station 36 at which may be located a conveyorized UV curing apparatus 40 which conveys the articles past UV light sources **40*a* which cure the ink on the containers. As will be described in greater detail hereinafter, the preferred transfer arm means 37 includes a pair of tandem transfer arms 50 and 51 having suction devices or heads 52 and 53 each of which grasps simultaneously a container with each of the containers being lifted and carried through an arc of approximately 180° from the supply station 25 to the preregistering station 30 and from the latter to printing station respectively. The preregistered container from the preregistering station is transferred at a transfer position 48 (FIG. 3) to the second or print transfer arm means 38 which has a nest or head 57 at one end thereof which receives the preregistered container. The print transfer arm means 38 swings upward from the transfer position to a vertical position at the printing station 23 and in alignment with a chuck 42 and nose spindle 44**. The transfer movements are short arcuate movements which are fast and which may have the same arcuate extent of travel for each of a plurality of sizes of containers. As will be explained in greater detail hereinafter, the transfer arms are oscilated by rotatable drives the speed of which can be readily increased or decreased.

Also, it is preferred that previously printed container 20 be transfer from the printing station 23 to the UV curing apparatus 40 by an oscillating transfer motion using an oscillating discharge means which includes a pick off oscillating arm 60. The latter deposits the printed container into the UV curing conveyor apparatus 40 for curing of the ink.

Figure 4A:
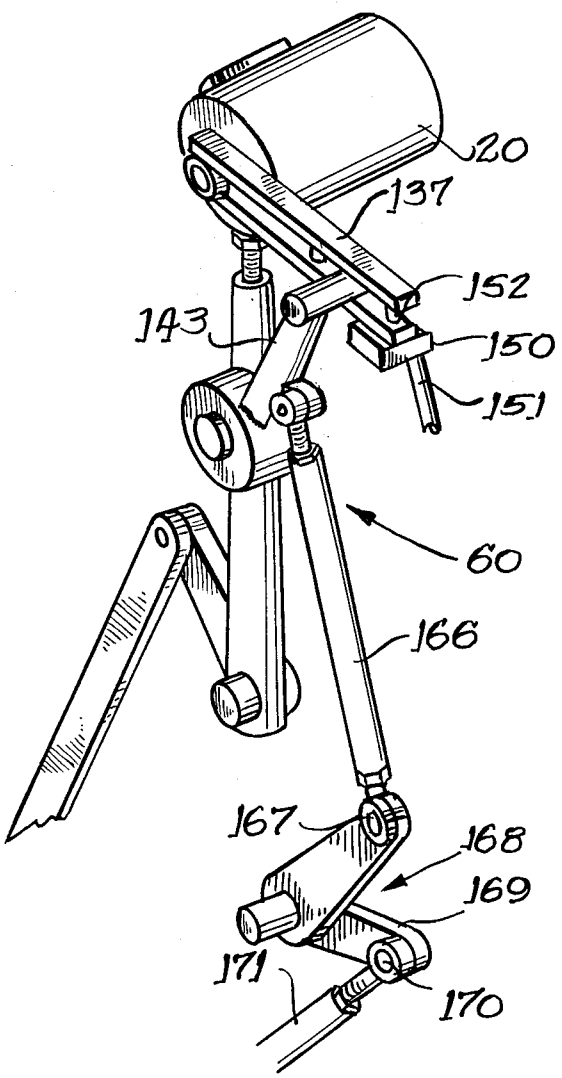
FIG. 4 is an illustration of the first transfer arm means positioned to grip a container at the supply station and at the preregistering station for removal therefrom.
Figure 4:
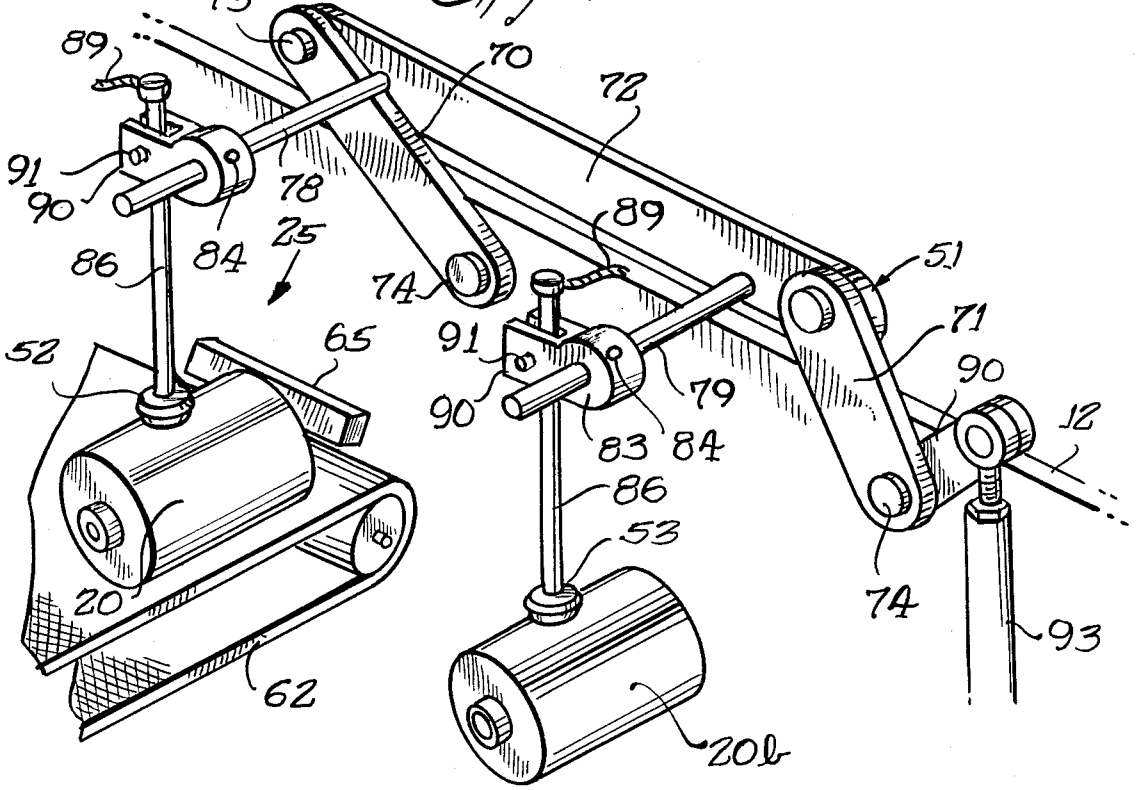

In accordance with the illustrated and preferred embodiment of the invention and as best seen in FIG. 4, the containers 20 arrive at the supply station 25 on an endless conveyor belt 62 which conveys containers continuously past a flame device 64 wherein the surfaces of the containers are treated by flame in a known manner to make them more receptive to ink. Each of the containers is fed forwardly to abut a stop 65 which holds the container at the position for being picked off by the first transfer arm means 37 with its transfer arm 50 swinging a suction head 52 thereon.

Thus, it will be seen that the preferred method of operation includes a conveying of containers 20 to a stop or supply location at the stop 65 from which the transfer arm 50 picks off the leading container from the conveyor while simultaneosly the second arm 51 of the tandem first arm means 37 is shifting the second container 20*b*.

These tandem transfer arms 50 and 51 include, in this preferred embodiment of the invention, a pair of upstanding parallel levers 70 and 71 (FIG. 4) joined at their upper ends by a horizontally extending common link 72 pinned and pivoted at these upper ends by pivot pins 73. The levers 70 and 71 are pivotally mounted at their lower ends to spaced bearings 74 carried by the frame side member 12. The levers pivot together through an arc of about 180°. Mounted on the levers are horizontal support rods 78 and 79 projecting forwardly from the link 72. Inner ends of the rods 78 are fastened to the link with the rods being aligned parallel and in a common horizontal plane. Mounted on each of the rods is one of the vacuum or suction heads 52 and 53 each of which has an upper slide bracket 83 with a horizontally extending bore through which projects an associated rod 78 or 79. A set screw 84 threaded in the slide bracket is tightened against the rod to hold the suction head at a given location on the rod; and for different sizes of containers the set screw is loosened and the bracket 83 is shifted along the rod and then locked in position. The suction heads include a hollow vertical shaft 86 with the respective flexible suction cups 52 and 53 mounted at the lower end of the shafts and in fluid communication therewith. A flexible suction hose 89 extends from the frame to the upper ends of the hollow shafts 86 and is in fluid communication through the shafts 86 to the suction cups 52 and 53.

The height of the suction cups 52 and 53 may be readily moved vertically for different diameters of containers. To this end, the slide brackets 83 carry a split clamp portion 90 which is tightened by a screw 91 to grip the shaft 86 and to hold it at the desired vertical position.

The oscillating movement of the tandem transfer arm means 37 is not of constant velocity as is desired to move the suction head 53 quickly after depositing a container 20*b* into the nest 57 on the print transfer arm 38 so that the container does not hit the suction head 53 as the nest 57 and the container 20*b* is being swung upwardly to the printing station 23. To these ends, as best seen in FIG. 4, the illustrated drive for the tandem transfer means includes a crank 90 having a lower end fixed to a hollow shaft portion 90*a* which rotates about a fixed bearing post 92 secured to frame plate 12. The lower end of lever 71 is fastened to the crank shaft portion 90*a* to turn when the crank 90 turns. A free end on the crank 90 connected by a pivot pin 91 to the upper end of an adjustable link 93 which is pivotally connected by a pin 94 to one end of a driven crank lever 96 which is pivoted at its opposite end by a pin 97 to the side frame member 12. The crank lever is driven by a camming roller 99 mounted in a slot 100 in the crank lever. The camming roller 99 is rotatably mounted on a rotatable drive disk 101 to turn around an axis 103 for the disk and of the shaft 102 carrying the disk. The shaft 102 is mounted for rotation in the side mounted in the frame 12 and is rotated by a sprocket 104 fixed to the shaft. A drive chain 106 is entrained about the sprocket. When the spocket 104 is rotated from the position shown in FIG. 3, the camming roller 99 moves through about 300° and moves the suction head 53 faster away from the nest 57 and then for the 60° arc of the drive roller 99 to bring the transfer arms 50 and 51 back to the pick up position shown in FIG. 4, the suction heads are slowing down in movement as they approach the position to engage the next containers 20 and 20*b*.

The container 20*b* is deposited in the nest of the suction head 57 of the print transfer arm 51 when it is in the position shown in FIG. 4, which is its lowest horizontal position; and the print transfer arm means 38 swings upwardly to a substantially vertical position to deliver the container to the printing station 23 as best seen in FIG. 5. The container is held in the nest 57 which is an arcuate plastic member opening upwardly and which has suction ports therein which are connected to a vacuum hose 115. That is, the head 57 has suction ports 57*a* therein to provide reduced pressure to the underside of the container so that it will be held and maintain its preregistered position as it is swung upwardly by the head to the print station. The lower end of the hose is connected to a suitable vacuum pump. The illustrated print transfer arm has its suction head 57 connected at one end to a threaded shaft 118 which is threaded into a threaded bore 119 in the upper end of a tapered member 120 which is fastened at its lower end to a shaft 121 and keyed thereto at 122 to turn with the shaft 121. By turning the adjustment screw 118, the transfer head may be raised or lowered to the desired adjusted position depending upon the diameter of the container.

The drive for the print transfer arm means 55 includes a driven crank 124 which is secured at a lower end to the shaft 121 and is keyed thereto to turn the shaft and the transfer arm. The upper end of the driven crank 124 is pivotally connected by a pin 127 to the upper end of an adjustable link 129 which is connected by a pin connection 130 at its lower end to a rotatable crank arm 131 which is secured to and driven by a shaft 132 mounted in the frame for turning movement. The shaft 132 has mounted thereon a pair of sprockets 134 and 135. The sprocket 135 drives the chain 106 for the tandem transfer arm means 37. The other sprocket 134 fixed to the shaft 132 is driven by an input drive chain 138 which turns both the transfer arm 38 and the tandem transfer means at the same time nd in the same direction as the shaft 132 is continuously rotated by the input drive chain 138. Thus, it will be seen that the chain 138 drives the sprocket 134 to rotate the crank 131 which drives the link upwardly and downwardly to pivot the crank 124 to turn the shaft 121 which oscillates the transfer arm 38 and the suction head 57.

The takeoff or discharge transfer means 60, as best seen in FIG. 5, preferably includes an oscillating lever 155 and a pair of gripper fingers 136 and 137 which are pivotally mounted about central shaft 140 to pivot between the open position releasing the container and the illustrated closed container gripping position shown in FIG. 5, in which the gripping fingers has its arcuate curved ends 141 and 142 in gripping engagement with the small diameter neck end 20*d* of the container. The neck is not covered with ink so that the container may be removed without smearing any ink thereon. The preferred grippers includes a contractual spring 144 pinned at opposite ends to the respective gripping fingers and pulling the gripping fingers toward each other to pivot about the central shaft 140. To shift the fingers to the open space position and thereby stretch the contractile spring 144, there is provided at the other free ends of the gripping fingers 136 and 137, a solenoid 150 which preferably is an air-operated solenoid operated by an air line 151 to pull inwardly its plunger 152 to pivot the outer free ends of the gripper fingers together. On release of the air pressure, the spring 144 will pull the gripper fingers together into tight gripped relationship with the neck of the container. The shaft 140 of the grippers is mounted on the upper end of a pivotally moveable lever 155 which in turn is pivoted on a shaft means 156.

To swing the discharge transfer arm means 60 through its oscilating transfer stroke, there is a linkage drive means as best seen in FIG. 5 which includes a link 166 connected at a pin 164 at its upper end to a bracket 167 fastened to the.gripper arm lever 155. At its lower end, the link 166 is connected by a pin 167 to a bell crank 168. The bell crank has a further crank arm 169 which is connected by a pin 170 to a short link 171 extending to a pinned connection 172 to a crank arm 173 which is keyed to a rotatable drive shaft 176. The rotatable drive shaft has a double sprocket arrangement with one of the sprockets 174 driving the chain 138 and with the other sprocket 175 being driven by a drive chain 177. The sprocket 175 is secured to the shaft 176 to turn the crank 173 and then operate through the above-described linkage to pivot and oscillate the pick transfer off arm 60. Thus, it will be seen that the pick-off arm 60 moves through a short arcuate stroke in timed relationship to the oscilatory strokes of the supply transfer arms 50 and 51 and the print transfer arm 38 all driven by a common chain drive.

Figures 1, 2:
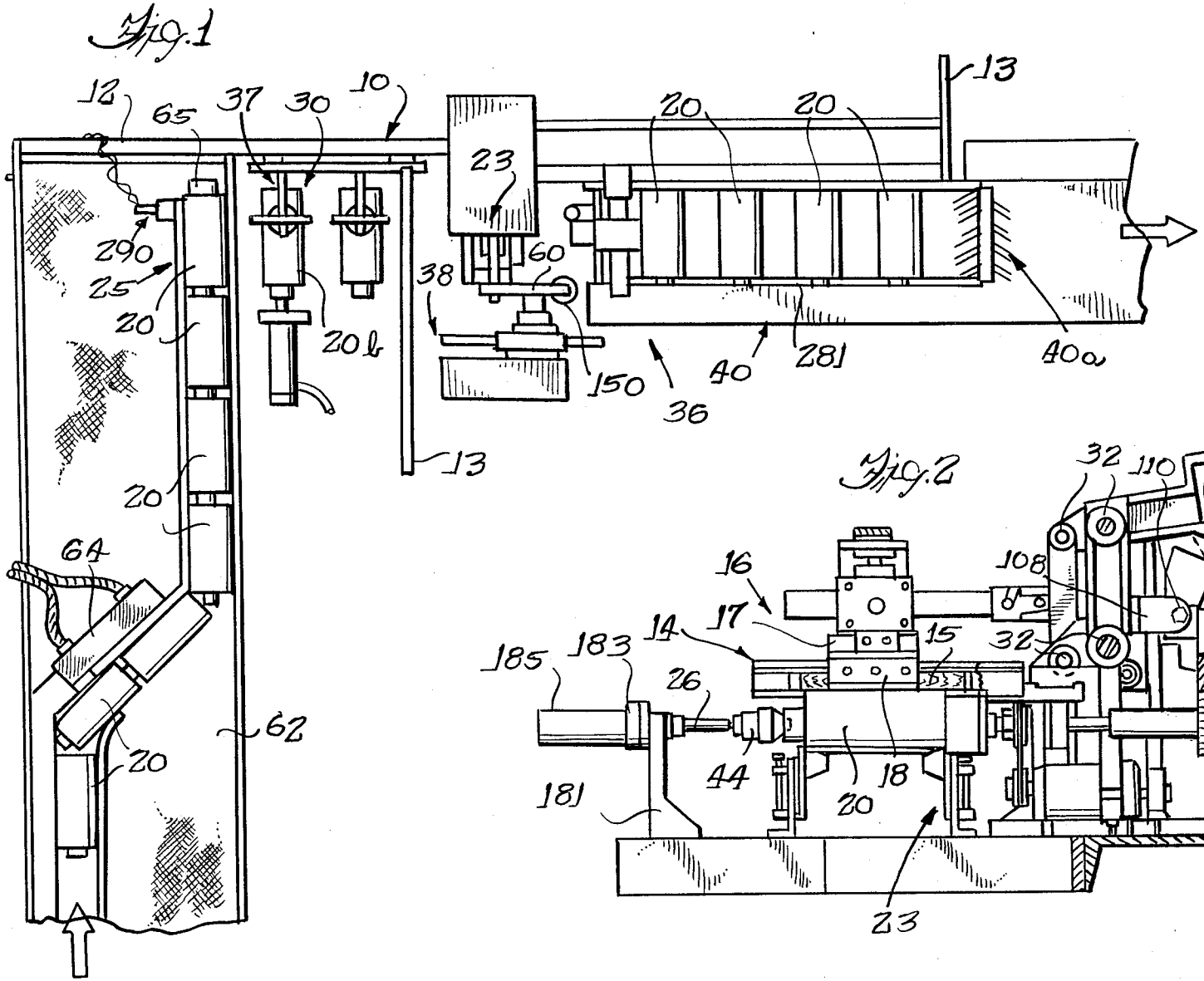
FIG. 1 is a plan view of an apparatus constructed in accordance with the preferred embodiment of the invention.
FIG. 2 is a end view partially sectioned of the screen frame and printing head assembly.

In order to remove the side end of the container disposed within the chuck 42 at the printing station 23, the takeoff gripper fingers 136 and 137 may be shifted outwardly in the axial direction of the container prior to the containers being swung through an arc to the curing apparatus 40. To this end, the grippers are moveable with the movable nose cone which is moved inwardly and outwardly relative to its stand 181 (FIG. 2). The nose cone is slideably mounted in a bracket 183 for rectilinear movement by an air cylinder 185 which has an air hose connected thereto. The entire carriage is mounted for reciprocation toward and from the chucks 24 and includes slides on the carriage slidable along guide rods mounted on the stand 181. An air cylinder is connected to the carriage to push and pull the carriage along the guide rods.

Turning now to FIG. 7, there is shown the chuck means 24 for gripping the container and for rotating the container during the print operation relative to the overhead screen through which ink is being pushed by a squeegee assembly 16. When the container is inserted into engagement with the chuck ng 200, a sensing pin 201 is pushed against a spring 202 with its interior end 203 signalling that the container is ready and present. When the container is in engagement with the chuck a rotatable register pin 205 carried on an insert 206 rotatably mounted within the chuck engages the ramp on the container. The pin 205 moves through a short arc, for example, about 5° to abut the ramp and the container is held stationary by tne chuck which is being driven in the opposite direction by a slip clutch drive means 210. More specifically, the slip clutch drive means 210 includes a small drive motor 211 which drives a timing belt 212 for driving a pulley 213 which is secured to the outer periphery of a rotable housing casing 215 to turn the same. The drive motor 211 includes a slip clutch 220 which will be described in greater detail in connection with a similar clutch used as the preregistering slip clutch 245 described hereinafter.

The container 20 is rotated through the printing stoke at a rotational velocity equal to the linear velocity of the screen 15 by a conventional drive including a rack 225 (FIG. 7) which is movable with the screen and turns a gear 226 which is attached to a central shaft 227 which extends through the side frame member 12 to the insert 206 to drive the pin 205 which rotates the container because the pin is in engagement with the ramp on the container. The turning movement moves through the printing cycle which may be a complete revolution or a part of a revolution as for printing on an oval container. This printing motion is generally as disclosed in U.S. Pat. No. 4,282,806 and is conventional and hence need not be described in detail herein. Likewise, the mounting of screen and squeegee assembly on the frame is generally the same as described in U.S. Pat. No. 4,282,806 and need not be repeated herein.

Turning now to the illustrated preregistration means, shown in FIG. 8, it includes a chuck 240 which has an outer rotatable housing 241 which has a tooth portion 242 serving as a pulley in an engagement with a tooth driving belt 243 which extends to the slip clutch 245 driven by a shaft 246 of a motor 248 mounted on the frame plate 12. The slip clutch 245, as best seen in FIG. 8, has a flanged body 250 mounted on and pinned to the motor drive shaft 251 to turn with the same. The flanged body has an inner circular metal disk 252 with a circular face in frictional engagement with a circular face of facing circular friction disk 253. The friction disk 253 is pinned at 258 to the drive pulley 260 and likewise a second circular friction disk 253*a* is pinned to the opposite sidewall of the drive pulley. Mounted on the shaft 250 is another circular metal 259 which has inner face engaging the friction disk 253*a*. A concave spring washer 270 is engaged by a threaded nut 271 threaded on a threaded end of the shaft 246. The nut is threaded on the shaft to compress the spring washer 270 which urges and biases the friction disks 253 and 253*a* with a predetermined amount of force into engagement with the metal disks 252 and 259 to form the slip clutch. The force at which the clutch slips may be adjusted by turning the nut 271 and thereby either compressing or releasing the compression of the concave washer 270.

In order to handle different diameters of containers 20*b* and to have a preregister pin 265 aligned with a ramp on the bottom wall of the container, the preferred preregister pin 275 is mounted on a movable slide 276 (FIG. 9) so as to be moved relative to the turning axis or center line 277 of the preregistering chuck 240 so that the pin may be moved radially inwardly or outwardly to accomodate the different diameters of containers. The slide 276 is mounted in a dovetail slot 279 in a stationary circular post 280 within the chuck housing 241 for sliding movement in a radial direction relative to the turning axis 277; and a set screw 278 secures the slide in adjusted position on the post. Thus, the chuck housing 241 is driven by the belt 243 to turn the container **20*b* to bring its ramp against the stationary pin 275 which then holds the container 20*b* while the chuck housing remains stationary and the timing belt 243 causes the slip clutch 245 to slip. Thus, the container is ready to be picked up with its ramp already at the preregistered position which is closely adjacent the final reference position it will assume when positioned by the register pin 205 at the printing station 23**.

After printing, the printing discharge arm 60 will lift the container 20 and drop it into a movable wire basket or carrier 280 (FIG. 5) of a known type of UV curing apparatus 40. The illustrated airing apparatus is a conventional apparatus including a chain conveyor 281 having a plurality of wire baskets 280 on the chains with each basket arriving beneath the discharging pick off transfer fingers 136 and 137 which open and drop the container into a basket therebeneath. Preferably, a chain drive (not shown) extends from the screen printing apparatus to the conveyor drive of the UV curing apparatus so that the baskets are timed to be beneath the fingers as they open and discharge the printed container.

Figure 3:
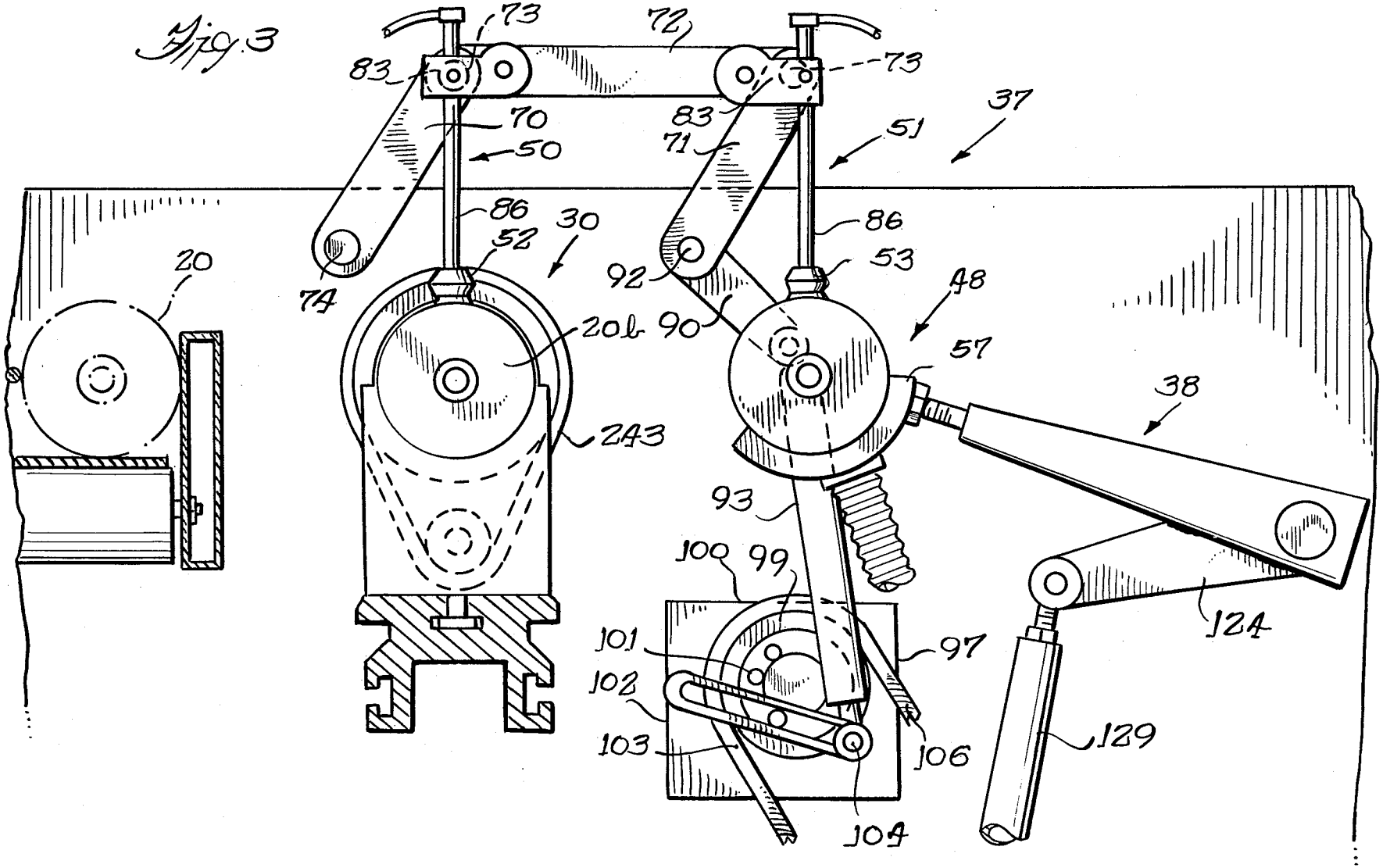
FIG. 3 is a view of the transfer means for transferring a pair of containers to the preregistering means and the transfer position.

As an aid to understanding the invention, a brief review of the operation of the illustrated screen printing apparatus will now be given. The containers are continuously moved by an inlet or supply belt conveyer 62 through a flame station and flame means 64 at which a flame pretreats the container. Each container is stopped in its forward travel by the conveyor belt when it engages the stop 65 at which is located a photoelectric sensor 290 which determines that the container is properly oriented with its neck **20*d* extending upstream and that the container is present before allowing handling operations to continue. That is, the photosensor is activated if it sees a neck 20*d* at the stop 65 or fails to see a container at the stop. The tandem transfer arm means 37 will then swing the first suction head 52 to grip the container at the stop while its parallel suction head 53 grips the container 20*b* (FIG. 4) which has been preregistered at the preregistration station 30. A short arcuate swinging movement to the right and in the clockwise direction as shown in these drawings for about 180° transfers the container from the stop into the preregistration chuck means 240 (FIG. 8) and simultaneously delivers the preregistered container 20*b* into the nest 57 of the print transfer arm means 38, as shown in FIG. 3. Because of a unique drive of the tandem transfer arm and its suction head 53, the latter is quickly raised away from the nest 57 so as to not interfere with the upward travel of the print transfer arm 38 which is moving the nest 57 at a lower speed at this time. The transfer head nest 57 holds the container by suction against falling and against turning and shifts it up to the print station 23 at which the nose cone 26 (FIG. 7) reciprocates inwardly to engage the mouth of the container and to blow air into the hollow interior of the container from the air line connected to the rotatable spindle 26. The pin 205 moves to engage the ramp through a short distance usually about 5° and the container is thus in the reference position with the chuck 42 holding the container against further turning movement. Then the printing operation begins with the screen 15 and rack 225 moving to turning the gear 226 and the shaft 227 to rotate the chuck 42 and the bottle in timed relationship so that there is no relative slipping movement between the container surface and the screen surface as would cause smearing of the ink which is being forced through the screen by the squeegee assembly 16**.

Simultaneously with the printing operation there is also the preregistering operation going on with the chuck 240 (FIG. 8) operating through its slip clutch 245 to turn the chuck to bring the ramp on the container against the stationary pin 275 which then holds the container **20*b*** as the clutch slips with the container now in the preregistered position.

At the finishing of the printing operation, the pick off transfer arm 60 (FIG. 5) carrying the gripping fingers 136 and 137 is swung in counter clockwise direction from a location away from the neck of the container towards the container neck to bring the gripping surfaces on the ends of the fingers 136 and 137 into gripping relationship with the neck of the container. The gripping occurs when the solenoid 150 is released allowing the contractual spring 144 to pivot the fingers to a closed clamping position about the container neck. The carriage which retracts the nose cone 26 from the bottle likewise carries the gripper fingers 136 and 137 outwardly to pull the wide end of the bottle from the registering pin so that the bottle grippers may now be swung to drop the container into the baskets 280 on the conveyor 281 of the curing apparatus 40. That is the solenoid for the grippers is charged with air to swing the gripper fingers open thereby releasing the container neck to discharge the container into the basket. The ink is then cured and the container is conveyed through the curing apparatus 40.

From the foregoing it will be seen that new and improved apparatus in which the containers are moved by inexpensive oscillating transfer arms which are moved by continuing, turning cranks driven by a common chain means or drive. The speed of operation may be changed merely by changing the speed of rotation movement without any adjustments. Size adjustments for different sizes of containers can be readily made by moving the preregistered slide to change the radial distance of the preregister pin from the center line. The nest 57 can be shifted inwardly or outwardly by turning the threaded screw 118.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. In a screen printing apparatus for automatically handling and printing on objects, the combination comprising:

a frame, a screen printing station on said frame having a squeegee and screen assembly for screen printing on objects, means for supplying a plurality of objects to a supply station for printing, a first oscillatory transfer means for picking up a container at said supply station and for swinging the object through an arcuate path to a preregistering station, preregistering means at a preregistering station for rotating the object to a predetermined orientation, a second oscillatory transfer means for transfering a second object from the preregistering station by swinging the second object along an arcuate path to a transfer position, a third oscillatory means for receiving the second object at the transfer position and for swinging the second object through an arcuate path to the printing station, and discharge means for removing a third and printed object from the printing station and for depositing the printed object at a discharge station.

2. The screen printing apparatus of claim 1 in which said first and second arm means comprise a pair of parallel transfer arms connected in tandem for simultaneous and equal arcuate travel by both the first and second objects.

3. An apparatus in accordance with claim 2 in which said first and second transfer means each have an oscillating arm carrying a suction head for gripping the upper surface of an object.

4. An apparatus in accordance with claim 1 in which the first and second oscillatory transfer means each have a transfer arm oscillating through a predetermined arc of movement and in which a drive means for each of the respective oscillatory transfer means comprises a continuously rotating drive shaft and a crank operated linkage means for oscillating the respective first and second transfer arms.

5. An apparatus in accordance with claim 1 in which the discharge means comprises an oscillatory arm having a means thereon for gripping a portion of the container which has not been printed upon and for swinging the printed object through an arcuate path of travel before releasing the grip to deposit the printed object.

6. An apparatus in accordance with claim 5 in which a chuck for rotating an object is located at the printing station, means for moving the gripper transfer arm and the gripped object in a direction parallel to the axis of the third object to remove it from the chuck at the printing station before swinging the third object into its arcuate path of travel to the discharge station.

7. An apparatus in accordance with claim 1 including a UV curing means at the discharge station having a conveyor for automatically conveying the printed articles through the UV curing means.

8. In a screen printing apparatus for automatically handling and printing on objects the combination comprising:

a conveyor means for supplying a plurality of containers seriatim to a predetermined supply position, a preregistering means at a preregistration station for rotating the containers to have a predetermined orientation prior to printing to reduce the amount of final rotation of the container to its reference position at the initiation of the printing operation, a pair of tandem transfer arms each movable with a swinging oscilatory movement for transferring simultaneously a first container from the supply position to the preregistering means and for transferring a preregistered container to a transfer position, a print station transfer arm for receiving the container from the second tandem transfer arm and for swinging the transferred preregistered container to the printing station, a screen printing means at the screen printing station including a screen and squeegee assembly for applying ink to the container, and a discharge means for removing the printed object from the printing station at the end of the printing operation.

9. An apparatus in accordance with claim 8 in which the discharge means comprises:

a discharge transfer arm for gripping the printed container and for swinging the container through an arcuate path to the discharge station.

10. The apparatus of claim 9 in which the discharge transfer arm comprises a pair of gripping fingers for gripping the neck of the container.

11. An apparatus in accordance with claim 8 in which the conveyor means comprises a continuously traveling conveyor and in which a flame treating means treats the surfaces of the containers as they are conveyed along to the supply station.

12. An apparatus in accordance with claim 11 including a UV curing means having UV light source and a conveyor means for conveying printed containers for irradiation by the UV light source to cure the ink on the printed containers.

13. A method of automatically handling and screen printing objects such as containers comprising the steps of:

conveying a series of objects to the supply position, picking off a container at the supply position and swinging it through an arcuate path of travel to a preregistering station, simultaneously with the swinging of the first container to the preregistering station removing an already preregistered second container from the preregistrating station and swinging the second container through an arcuate path of travel to a transfer position, transfering the preregistered second container at the transfer position to another transfer means which swings the second container through an arcuate path of travel to a printing station, simultaneously with the movement of the first and second containers removing a third container having been printed from the printing station and discharging the same from the printing apparatus, rotating the container delivered to the preregistering station into a preregistered position which is closely adjacent the reference position at which printing commences on the container at the printing station, and simultaneously with the preregistering operation performing a printing operation on a container delivered thereto from the transfer position.

14. A method in accordance with claim 13 including the step of flame treating the containers while they are being conveyed to the supply station.

15. The method in accordance with claim 13 including the further step of checking the presence and orientation of the container at the supply station before allowing a feeding of the container to the preregistrating station.

16. A method in accordance with claim 13 including the further step of discharging the printed container by the steps of gripping a neck on the container and swinging the container through a short arcuate path of travel and then releasing the grip on the container to drop the same.

17. A method in accordance with claim 16 including the further step of aligning a conveyer basket beneath the discharging printed container and conveying the printed conveyor through a UV curing station at which UV light cures the ink on the container.

18. A method in accordance with claim 13 in which each of the arcuate movements of the containers is provided by the oscillating of the transfer arms by a continuously rotating drive means therefor.

19. A method in accordance with claim 18 including the further step of providing a common drive means connecting each of the rotating drives for the oscilating transfer arms and varying the speed of operation of handling of the objects by varying the speed of the common drive for the respective transfer arms.

20. In an automatic screen printing apparatus having means for transferring containers of different sizes, said apparatus comprising:

a first oscillating transfer arm means having a pair of suction heads thereon with the first one of said suction heads gripping a first object from a supply of objects and with the second of said suction heads gripping a container at a preregistration station, said suction heads on said transfer arm being adjusted vertically to accommodate different diameters of containers and said suction heads being shifted in the direction of the axial length of the containers in order to handle different lengths and diameters of containers, a preregistering chuck means at the preregistration station having a preregistrating pin movable radially with respect to the axis of the chuck means for being positioned to engage different radially located ramps on different diameters of containers being preregistered, a print transfer arm having a suction head for receiving preregistered containers from the second suction head, said print transfer arm suction head being adjustable in position to accommodate different diameters of containers, said print transfer arm swinging the preregistered container through an arcuate path to the printing station, a printing screen and squeegee assembly at the print station for applying ink to the peripheral surface of the container, and a discharge transfer means for removing the printed container simultaneously with the movement of the containers by the first transfer arm means and the print transfer arm.

* * * * *